US005228487A

United States Patent [19]

Thiermann et al.

[11] Patent Number: 5,228,487

[45] Date of Patent: Jul. 20, 1993

[54] POUR SPOUT

[75] Inventors: John H. Thiermann, Milwaukee; Paul R. Ruppel, Caledonia, both of Wis.

[73] Assignee: Briggs & Stratton Corporation, Wauwatosa, Wis.

[21] Appl. No.: 879,787

[22] Filed: May 6, 1992

Related U.S. Application Data

[63] Continuation-in-part of Ser. No. 767,243, Sep. 27, 1991:

[51] Int. Cl.[5] ..... B65B 1/04; B65B 3/04; B67C 3/00

[52] U.S. Cl. ..... 141/293; 141/291; 141/352; 141/368; 220/373; 215/261; 222/189

[58] Field of Search ..... 141/291, 346, 352, 353, 141/354, 368, 286, 293, 294, 292: 222/189, 542, 567, 568, 569, 570; 220/373, 374; 215/261

[56] References Cited

U.S. PATENT DOCUMENTS 3,078,883 2/1963 Beall, Jr. ..... 141/198
3,207,190 9/1965 Silbereis et al. ..... 141/198
3,289,712 12/1966 Smith ..... 141/352
4,667,710 5/1987 Wu ..... 141/198
4,834,151 5/9189 Law ..... 141/198

*Primary Examiner*—Henry J. Recla
*Assistant Examiner*—Steven O. Douglas
*Attorney, Agent, or Firm*—Andrus, Sceales, Starke & Sawall

[57] ABSTRACT

A pour spout for pouring a fluid, such as fuel, by gravity from a container to a tank. The spout includes a conduit having one end connected to the fuel container and having a second end to be positioned within the neck of the tank. A sleeve is mounted for sliding movement within the conduit and the outer end of the sleeve carries a closure which closes off the discharge end of the conduit. A seal is incorporated to prevent the entry of foreign particulate material into the sliding interface formed between the conduit and sleeve. The seal is provided by an annular skirt which overlaps with an annular flange together with an annular jacket of resilient foam material surrounding the sleeve and conduit at the location of the sliding interface.

13 Claims, 4 Drawing Sheets

POUR SPOUT

REFERENCE TO RELATED APPLICATION

This application is a continuation-in-part of U.S. application Ser. No. 07/767,243 filed on Sep. 27, 1991.

BACKGROUND OF THE INVENTION

Certain problems are encountered when pouring a liquid fuel, such as gasoline, from a container into a tank associated with an internal combustion engine, as used in a lawnmower, chainsaw, snowmobile, vehicle, or the like. One problem is overflow or spillage of the gasoline which can provide a health and safety hazard. In addition, escape of vapor from the tank to the atmosphere as the fuel is poured into the tank also provides a health, safety, and environmental risk.

To overcome these problems, it has been proposed in the past to incorporate a pour spout with the fuel can or container which automatically shuts off flow of fuel when the tank is filled. Pour spouts, as used in the past, have included a fuel conduit and a sleeve, which is threaded to the neck of the fuel container, is mounted for sliding movement within the fuel conduit. The outer end of the sleeve carries a valve or closure which closes off the fuel conduit. In devices of this type, the closure is spring biased to a closed position and a collar or abutment is mounted on the outer surface of the fuel conduit and is adapted to engage the upper edge of the tank neck when the spout is introduced into the neck, so that continued force applied through the container will move the sleeve axially relative to the fluid conduit to open the closure and permit the flow of fuel into the tank.

In one form of common pour spout the gasoline vapor and air within the tank is vented upwardly through the fuel conduit to the container, but this type of venting provides an intermittent flow of fuel in which the fuel flow is in slugs, as opposed to a continuous smooth flow.

It has also been proposed to include a vent tube in the pour spout, so that the vapor within tank will be vented through the vent tube to the container and thus provide a smoother flow of fuel.

Fuel tanks, as used on internal combustion engines have necks of various configurations and depths. If the neck is shallow, having a relatively short axial length, the lower end of the fuel conduit and vent tube of the pour spout may be located a substantial distance from the top of the tank. The flow of fuel through the spout will be terminated when the fuel level reaches the inlet of the vent tube and in this case, with the inlet of the vent tube being located a substantial distance beneath the upper end of the tank, the tank cannot be completely filled. On the other hand, if the tank neck is relatively deep, having a long axial length, the lower end of the spout will not extend into the tank with the result that overflow can occur. Thus, pour spouts, as used in the past, have not been capable of accommodating tanks with various neck configurations.

Certain pour spouts, as used in the past, have included a closure for sealing the vent tube when the fuel conduit is closed to prevent foreign material from entering the vent tube during periods of storage. If the fuel container is subjected to an elevated temperature during storage, a pressure buildup can occur in the container and when the spout is subsequently introduced into the fuel tank, a rapid and uncontrolled discharge of fuel can occur.

To eliminate this problem, some pour spouts have incorporated a provision for enabling the vent passage to be manually relieved prior to introducing the spout into the tank neck. However, manual relief of the vent tube can cause the discharge of fuel and vapor into the atmosphere and provide a safety and health hazard.

Another problem involves the entry of foreign particulate material such as dirt, sand or the like into the sliding interface or clearance formed between the sleeve and the conduit. Accumulation of such foreign material may hinder the sliding movement between the conduit and sleeve thus impeding proper operation of the spout, and may also cause premature failure of the spout.

SUMMARY OF THE INVENTION

The invention is directed to an improved pour spout for conducting a fluid, such as fuel, from a container to a tank. The pour spout includes a fluid conduit, and a sleeve is mounted for sliding movement within the conduit. One end of the sleeve carries a threaded cap which is adapted to be threaded to the neck on the fuel container, while the opposite or outer end of the sleeve carries a closure which is adapted to close off the outer end of the fuel conduit and prevent flow of fuel.

A vent tube is mounted within the sleeve and the outer or lower end of the vent tube extends generally radially and terminates in an inlet opening, while a check valve is mounted in the upper end of the vent tube and permits the flow of fuel vapor and air from the tank to the container, but prevents flow of fuel in the opposite direction.

Mounted on the outer surface of the fuel conduit is an annular collar, and as the spout is introduced into the neck of the tank, the collar engages the outer end of the tank neck. Continued downward force applied through the container to the sleeve, will move the sleeve axially of the fuel conduit to open the closure and permit the flow of fuel into the tank. As the fuel is introduced into the tank, the vapor and air in the tank is vented through the vent tube to the container. When the level of fuel in the tank reaches the location of the inlet to the vent tube, the flow of fuel will be automatically terminated.

As a feature of the invention, the collar is mounted for longitudinal movement on the outer surface of the fuel conduit to enable the spout to accommodate tank necks of different depths or lengths. By proper adjustment of the collar on the fuel conduit, the lower end of the spout can be properly positioned with respect to the lower end of the neck of the fuel tank to ensure that the tank will be fully filled.

As a further feature of the invention, a cap is mounted for rotation on the outer surface of the closure, and the cap carries a longitudinally extending tab which is adapted to register with the inlet to the vent tube when the closure is in the closed position. The tab will thus prevent the entry of foreign material into the vent tube, but the tab is spaced from the inlet such that fuel vapor and air flow is permitted through the inlet to prevent the buildup of pressure in a container in the event the container is subjected to elevated temperatures when in storage, or alternately, to permit the flow of air from the atmosphere into the container in the event the interior of the container is at a sub-atmospheric pressure.

The cap can be rotated to a second sealing position where the tab will fully seal the inlet to the vent tube to prevent the flow of fuel vapor and air therethrough.

With the tab in the sealing position, the container and spout can be transported in a vehicle without gas or vapor being discharged through the vent tube and into the vehicle.

The invention provides an automatic shut-off of the flow of fluid into the tank when the tank is full. By proper adjustment of the collar or abutment on the outer surface of the fuel conduit, the outer or distal end of the spout can be properly positioned with respect to the inner end of the tank neck to ensure proper filling of the tank.

The construction of the check valve, which is associated with the vent tube, provides smooth and effective venting or release of the vapor from the tank to provide a smooth, fast flow of fuel into the tank.

When not in use, both the discharge end of the fuel conduit and the inlet end of the vent tube, are closed off to prevent foreign material from entering the fuel conduit and the vent tube.

The rotatable cap on the fuel conduit closure not only effectively prevents the entry of foreign material into the vent tube when the closure is in the closed position, but will permit vapor flow through the vent tube to prevent a buildup of a pressure differential between the interior of the fuel container and the atmosphere during storage periods. By rotating the cap, the tab can be moved to a sealing position with respect to the vent tube to prevent flow of vapor or liquid through the vent tube. The sealing position is particularly useful when the fuel container is transported in a closed vehicle, thus preventing the escape of fuel vapor into the vehicle and preventing spillage of the fuel in the event the container should tip.

As yet another feature of the invention the annular space or clearance between the sleeve and the conduit is sealed to prevent the entry of foreign material such as dirt, sand or the like into the sliding interface formed therebetween. This seal is provided by an annular skirt depending from the threaded cap of the sleeve which overlaps with an upstanding annular flange projecting from the fluid conduit. The skirt and overlapping flange form a tortuous path that effectively prevents the entry of foreign material to the sliding interface. In addition to the skirt and flange, the seal may incorporate an annular jacket of resilient foam material surrounding the sleeve and conduit that functions as a filter for any particulate matter that may pass through the tortuous path formed by the skirt and flange. The jacket is disposed between the skirt and flange, and the sleeve and conduit at the location of the sliding interface.

Other objects and advantages will appear in the course of the following description.

BRIEF DESCRIPTION OF THE DRAWINGS

The drawings illustrate the best mode presently contemplated of carrying out the invention.

In the drawings.

Figure 1:
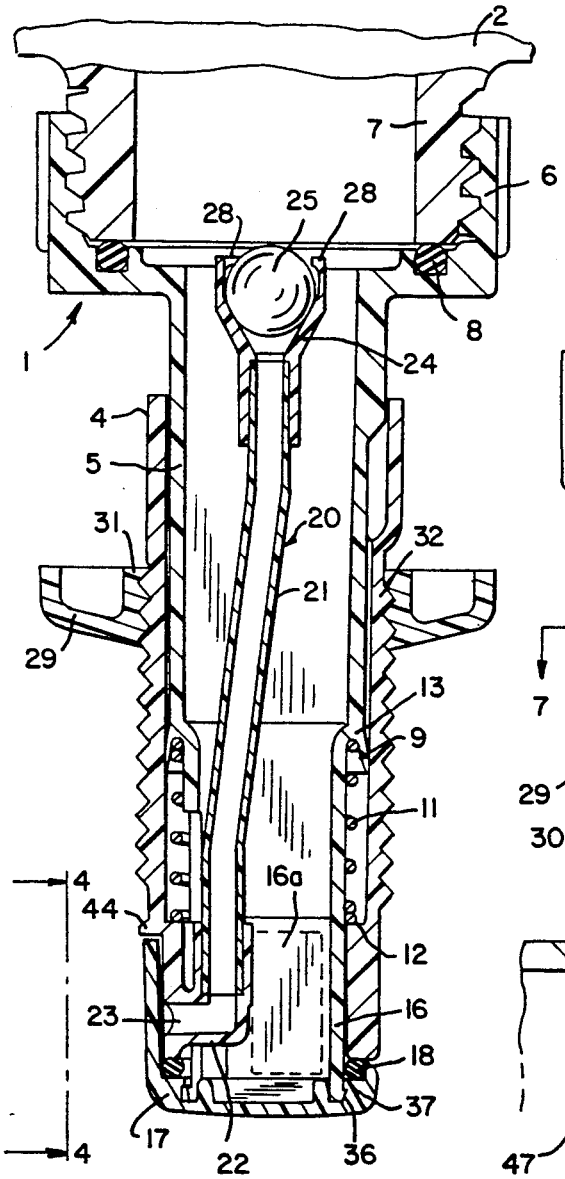
FIG. 1 is a longitudinal section of the pour spout with the closure for the fuel conduit being shown in the closed position.
Figure 9:
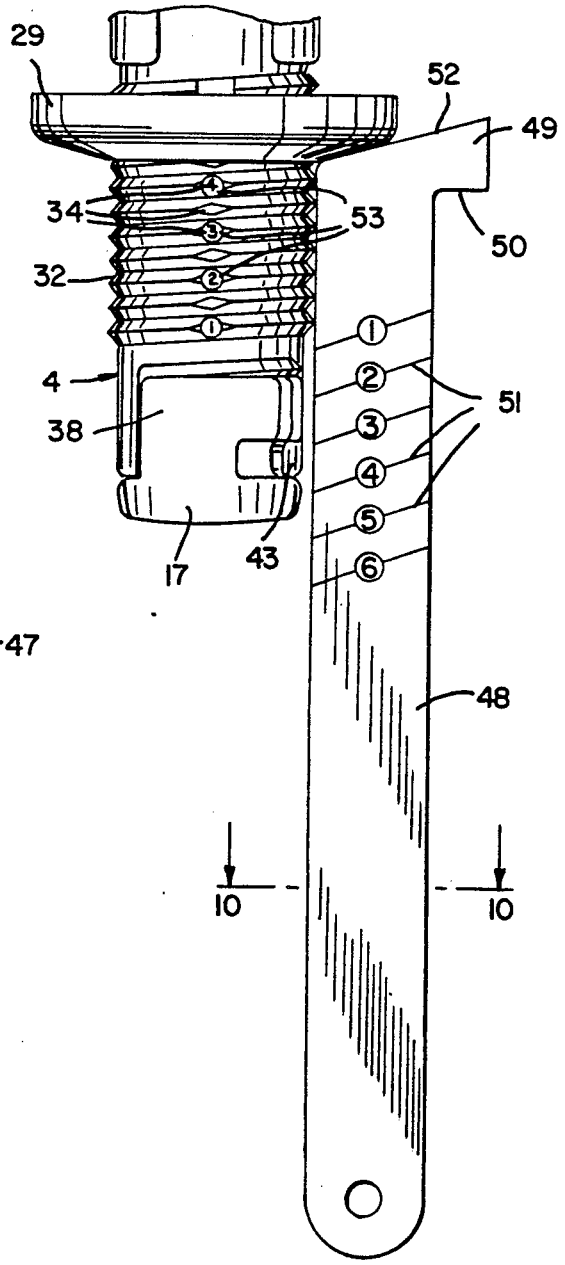
FIG. 9 is a side elevation of the gauge as applied to the pour spout.
Figure 11:
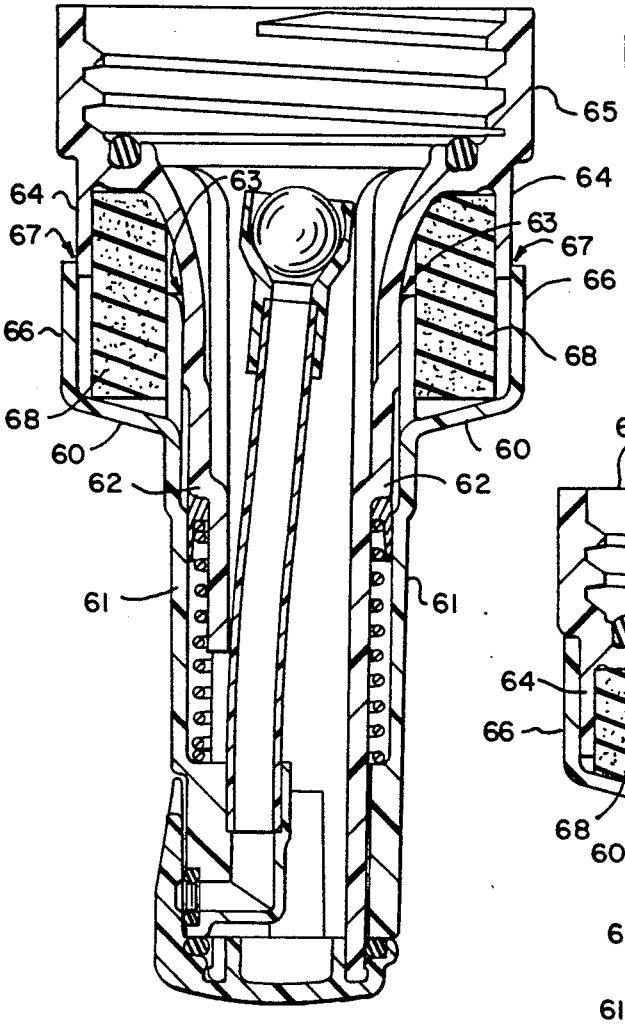
Figure 12:
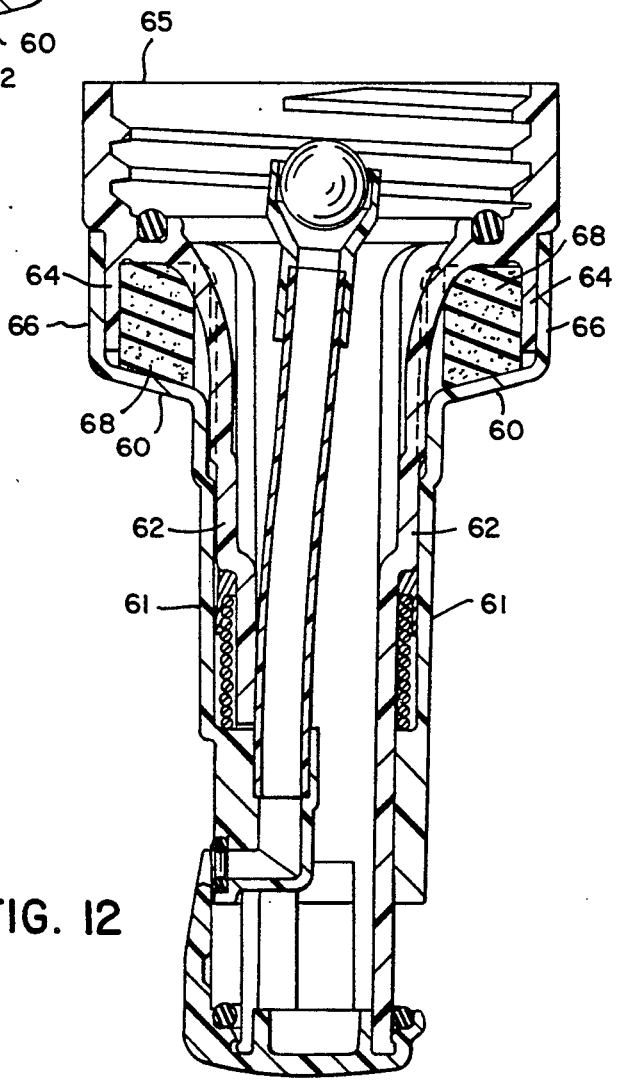

FIG: 10 is a section taken along line 10—10 of FIG. 9;

FIG. 11 is a longitudinal section view similar to FIG. 1 of a second embodiment of the pour spout illustrating the closure for the fuel conduit closed and a seal for the sliding interface between the fuel conduit and the sleeve; and FIG. 12 is a view similar to FIG. 11 illustrating the closure in its open position and the foam jacket of the seal in its compressed position.

DETAILED DESCRIPTION OF THE INVENTION

The drawings illustrate a pour spout 1 to be used for conducting a fluid from a container 2 to a tank 3, The spout has particular application for use in conducting or pouring a fuel, such as gasoline, from container 2 to a tank 3 which is associated with an internal combustion engine such as that used in a lawnmower, snowmobile, outboard motor, chain saw, vehicle, or the like.

Spout 1 includes a generally cylindrical fuel conduit 4 and a cylindrical sleeve 5 is mounted for sliding movement within the conduit 4. One end of sleeve 5 is provided with a threaded cap 6, which is adapted to be threaded to the neck 7 of container 2. A suitable resilient gasket or seal 8 seals the threaded connection between cap 6 and neck 7, as shown in FIG. 1.

The annular space, or clearance, between sleeve 5 and conduit 4 is sealed by a flexible lip 9 on sleeve 5 that bears against the inner surface of conduit 4.

Sleeve 5 is biased to the position shown in FIG. 1 by a spring 11. One end of spring 11 bears against an internal ledge 12 on the outer or distal end of conduit 4, while the opposite end of the spring is engaged with a seat 13 on sleeve 5.

Figure 7:
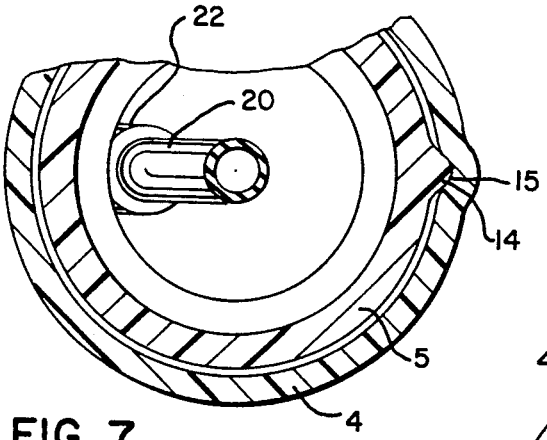
FIG. 7 is a fragmentary section taken along line 7—7 of FIG. 2.

To prevent relative rotation between sleeve 5 and conduit 4, sleeve 5 is provided with one or more longitudinally extending lugs 14 which are spaced circumferentially around the sleeve, as shown in FIG. 7, and lugs 14 are received within internal recesses 15 in the conduit 4. The engagement of lugs 14 with recesses 15 will prevent relative rotation between conduit 4 and sleeve 5, thus ensuring that there will be no danger of damage to internal components of the spout if the cap 6 is threaded to neck 7 by grasping the distal end of sleeve 5.

The outer or distal end of sleeve 5 is provided with a series of longitudinally extending legs 16 which carry a closure or valve 17. The spaces between legs 16 provide discharge openings for the fuel when the closure 17 is in the open position, as will be hereinafter described. Closure 17 is provided with an O-ring seal 18 and when the closure is in a closed position, as seen in FIG. 1, the O-ring 18 provides a seal against the edge of the conduit 4 to prevent the flow of fuel through the conduit.

Figure 2:
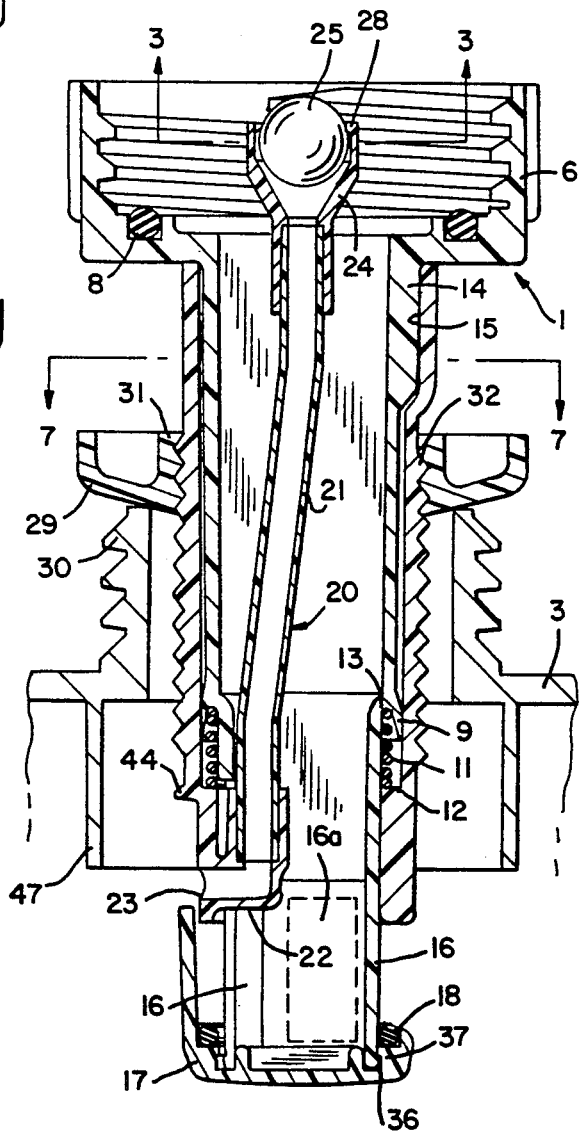
FIG. 2 is a view similar to FIG. 1 with the closure being shown in the open position.
Figure 3:
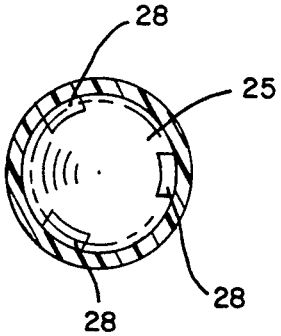
FIG. 3 is a section taken along line 3—3 of FIG. 2.

Mounted within sleeve 5 is a vent tube 20 which includes a longitudinal section 21 and a radial section 22 which terminates in an inlet port 23. As shown in FIG. 2, the axis of inlet port 23 faces radially and the inlet port communicates with the interior of tank 3 when the closure 17 is open.

A check valve is associated with the vent tube which permits the flow of fuel vapor and air from tank 3 through the vent tube 20 to container 2 but prevents flow of fuel in the opposite direction. In the preferred form of the invention, the check valve includes a valve seat 24 which is connected to the inner end of the vent tube and a ball valve 25 is adapted to engage seat 24. Secured to the inner surface of the seat 24 are a plurality of inwardly extending lips 28 which prevent the ball 25 from being completely dislodged from seat 24. With ball 25 engaged with valve seat 24, flow of fluid through the vent tube 20 is prevented. As fuel is poured from container 2 through the spout into tank 3, a partial vacuum will be created in the container, and the pressure differential between the container and the tank will unseat the valve 25, moving the ball 25 upwardly from seat 24 against lips 28 and the fuel vapor and air will then be vented to the container 2.

An annular collar 29 is mounted on the outer surface of conduit 4 and in the fuel pouring mode is adapted to engage the upper edge of neck 30 of tank 3. With collar 29 engaged with neck 30, downward force applied through the container 2 to sleeve 5 will move the sleeve longitudinally relative to conduit 4 to open the closure 17 against the force of spring 11 and permit the fuel to flow from the container 2 through conduit 4 and through the spaces between legs 16 to the tank.

Tank necks 30 may have various configurations and axial lengths or depths. In order to accommodate necks of varying lengths, collar 29 is mounted for adjustable movement on conduit 4. In this regard, collar 29 is provided with internal threads 31 which engage the thread 32 on the outer surface of conduit 4. By threaded adjustment, the collar can be moved axially along the conduit 4. To lock collar 29 at any desired position along the length of conduit 4, the inner periphery of the collar is provided with a nib or projection which is adapted to engage flats 34 on the external thread 32. As collar 29 is preferably formed of a thermoplastic material, the nib is relatively flexible and will deform as the collar is rotated and the nib moves out of registry with the flat. Alternately, threads 31 and 32 can be formed with an interference fit which will maintain collar 29 in a given position unless a substantial rotational force is applied to the collar. This construction enables the collar to be held in position relative to conduit 4, thus permitting the lower end of the spout 1 to be properly positioned relative to the lower edge of neck 30, so that the tank can be fully filled with fuel.

As a feature of the invention, a cap or closure 17 is mounted for rotation on the lower end of tube 5. In this regard, the lower end of tube or sleeve 5 is formed with an outwardly extending shoulder 36 which is engaged beneath an inwardly extending annular ledge 37 on cap 17. The engagement of shoulder 36 with ledge 37 prevents axial displacement of the cap and permits the cap to rotate relative to the tube 5.

Figure 4:
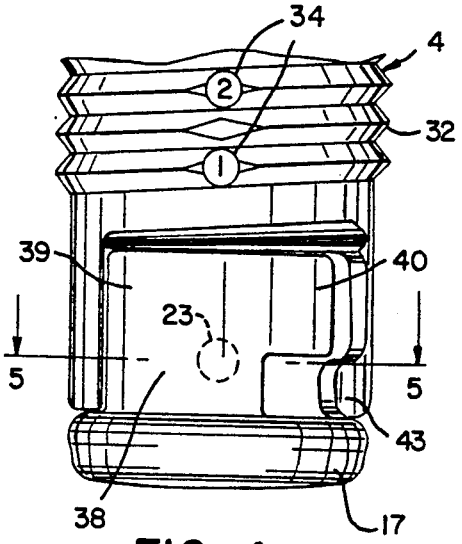
FIG. 4 is a fragmentary side elevation showing the rotatable cap on the closure.
Figure 5:
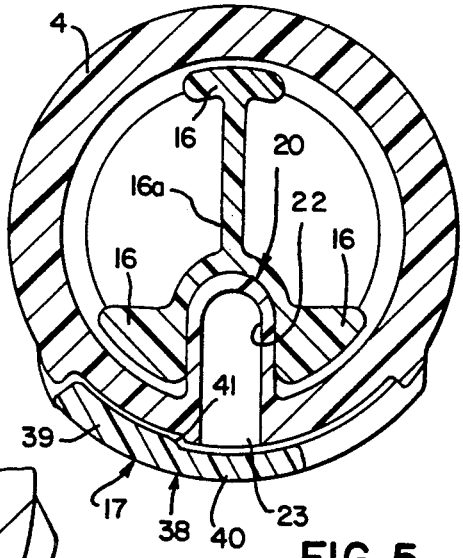
FIG. 5 is a section taken along line 5—5 of FIG. 4 and showing the tab on the cap in an obstructing position.
Figure 6:
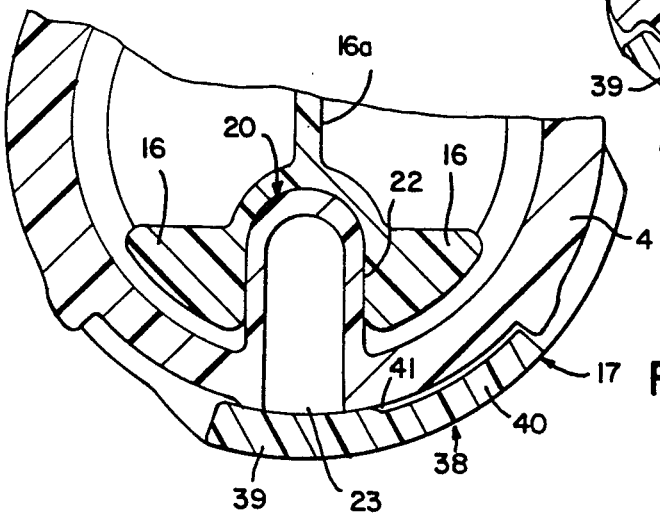
FIG. 6 is a view similar to FIG. 5 and showing the tab in the sealing position.

As best seen in FIG. 4, a tab 38 extends longitudinally from the periphery of cap 17 and tab 38 is provided with a pair of sections 39 and 40 which are connected by an inclined cam or ramp 41. Section 39 has a greater radial thickness than section 40, as illustrated in FIGS. 5 and 6.

When closure 17 is in the closed position, as shown in FIG. 1, the thinner section 40 will register with the inlet port 23 of the vent tube, thus preventing the entry of foreign material into the inlet port. However, as seen in FIG. 5, the section 40 is not in sealing engagement with the vent tube, but is spaced slightly therefrom to permit the flow of vapor and air through the inlet port 23. Thus, if a buildup of pressure occurs in the container, as for example if the container is heated by exposure to sunlight, the pressure buildup can be vented through the clearance between the tab section 40 and port 23. Alternately, if the container is stored in a cool location, the pressure within the container can decrease and air can flow from the atmosphere through port 23 to the container to equalize the pressure and prevent collapse of the container.

By rotating cap 17, the thicker section 39 of tab 38 will be brought into registry with the port 23 of the vent tube. This provides a seal for the port 23 which will prevent flow through the port. This position of the cap is useful when transporting the container 2 in a closed vehicle and will prevent the escape of fuel vapors through the vent tube into the vehicle. Further, the seal will prevent spillage of fuel if the container should tip.

When the tab 38 is in the sealing position, the lower edge of section 40 will engage a stop 43 on the distal end of conduit 4, thus preventing the closure 17 from being opened when the port 23 of the vent tube is sealed. To enable the closure 17 to be opened, the cap must be manually rotated to the position shown in FIGS. 4 and 5, before the spout is inserted in the tank neck 30, thereby releasing engagement of section 40 with stop 43 and venting any buildup of pressure in container 2 through port 23 by virtue of the thin section 40 then being in registry with the port. With this construction, any pressure buildup is automatically and slowly vented before the spout is inserted into the tank.

A protective bead 44 is formed on the outer surface of fuel conduit 4 above tab 38, which will prevent the tab from catching on the tank neck 30 as the spout is withdrawn from the neck.

A deflector **16*a* connects the lower portions of legs 16 and serves to direct the fuel away from the port 23 of the vent tube 20, and thus prevents the fuel from splashing through the gap between tab 38 and the lower end of vent tube 20** and possibly clogging the vent tube.

In operation, the cap 6 is threaded on the neck 7 of the container 2 and collar 29 is positioned along the conduit 4, such that when the spout is introduced within the tank 3, the inner or lower end of the spout will be slightly below the lower extremity of the annular skirt 47 which borders the opening in the tank neck 30. The spout 1 is then introduced into the tank neck 30 until the collar 29 engages the outer edge of the neck. Continued downward movement of the container 2 and sleeve 5 will cause the sleeve to move downward relative to conduit 4 to open the valve or closure 17 and permit fuel to flow through sleeve 5 into tank 3. As the tank 3 is filled with fuel, air and vapor within the tank will be vented upwardly through vent tube 20 and check valve 25 to the container 2. When the liquid level in tank 3 reaches the port 23 in the vent tube 20, the flow of fuel will cease. The spout can then be withdrawn from the tank and the spring 11 will force the sleeve 5 and closure 17 to the closed position to seal the conduit 4 and prevent further flow from the conduit. With the closure or valve 17 closed, the tab 38 will be aligned with port 23 to prevent foreign material from entering the vent tube when the spout is stored. However, the tab 38 will be slightly spaced from the port, as shown in FIG. 5, so that any pressure differential between the atmosphere and the container during storage can be vented through the clearance.

During transporting of the container 2 and attached spout in a closed vehicle, cap 17 can be rotated to move the section 39 of tab 38 into registry with port 23 which will act to seal the port to prevent escape of vapor from the container and into the vehicle. At the time of use, the cap 17 must be rotated to move the section 40 out of registry with stop 43 to thereby enable the valve closure 17 to be moved to the open position. This ensures that any pressure buildup in the container will be vented before the spout is introduced into the tank neck and prevents a high pressure buildup in the container from blasting fuel from the tank when the spout is introduced into the tank neck.

Figure 8:
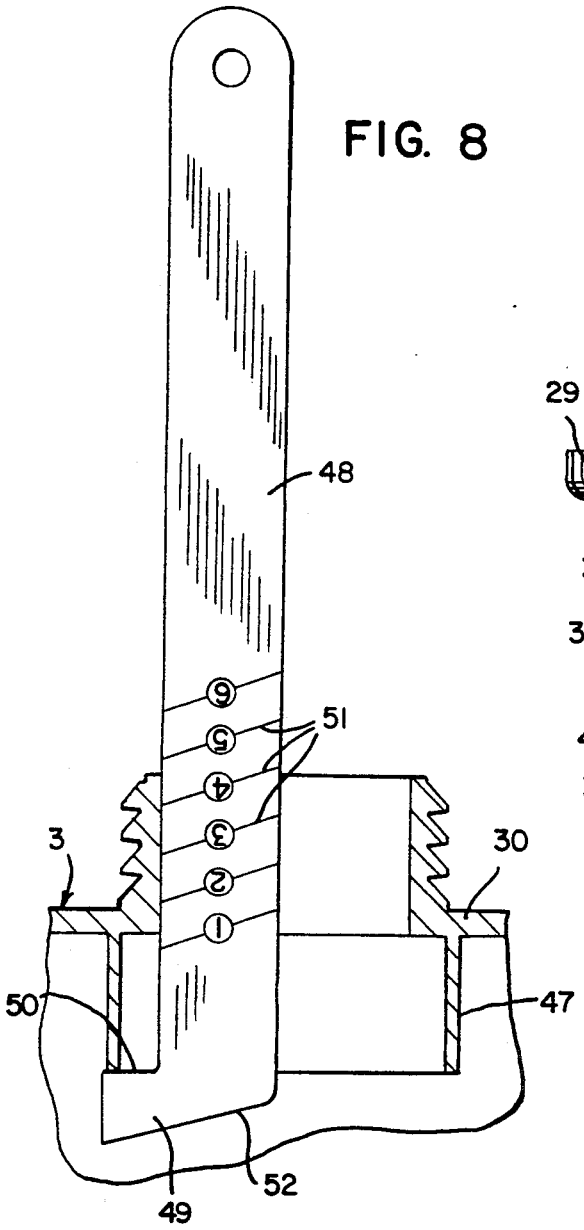
FIG. 8 is a side elevation of a measuring gauge inserted in a tank neck.
Figure 10:
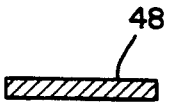

FIGS. 8–10 illustrate a gauge that can be used to accurately position the collar 29 with respect to the lower edge of the flange or skirt 47 which borders the tank neck 30. The gauge takes the form of a flat elongated stick 48 having a head 49 at one end and the head is bordered by an edge 50 which extends generally normal to the longitudinal edges of stick 48.

The body of the stick is provided with a plurality of spaced, parallel, graduated marking, or lines 51 which extend diagonally with respect to the longitudinal edges of the stick. The lines can be provided with numerals, i.e. 1, 2, 3, etc., as indicated in FIG. 8 and 9.

To utilize the gauge, the stick 48 is inserted downwardly into the tank neck 30 and the edge or abutment 50 is engaged with the lower edge of flange 47, as shown in FIG. 8. A reading is then taken on the markings 51 at a location coinciding with the upper edge of the tank neck 30. As shown in FIG. 8, this reading would be approximately 4.7. The gauge 48 is then removed from the tank neck and the edge 52 of head 49 is inserted against the lower edge of collar 29, as shown in FIG. 9. The collar can then be threaded upwardly or downwardly on the conduit 4 until the lower extremity of cap 17 is at a 4.7 reading, as shown in FIG. 9. The collar will then be at the proper location with respect to the lower edge of flange 47, thus ensuring that the lower end of spout 1 is properly positioned relative to the lower edge of flange 47, so that the tank can be fully filled with fuel and without overflow.

The diagonal markings 51 compensate for the fact that in one position, as shown in FIG. 8, the edge 50 constitutes the measuring surface, while in the position shown in FIG. 9, the surface 52 constitutes the measuring surface. Thus, the longitudinal distance between the opposed ends of the lines or markings 51 is equal to the distance between the edges 50 and 52.

As shown in FIG. 9, it is also possible to employ numerals 53 on the flats 34 of the external thread of conduit 4. The longitudinal distance between the numerals 53 on the flats equals the longitudinal distance between the lines 51 on stick 48. With this construction, the operator, instead of utilizing the gauge to set the position of the collar 29 as shown in FIG. 9 can merely thread the collar until the proper numeral 53 is located beneath the collar. Thus, the position of the collar can be set either by utilizing the gauge, as shown in FIG. 9, or by utilizing the numerals 53 on the flats 34 of the external thread 32.

Turning now to FIGS. 11 and 12, there is illustrated a second embodiment of pour spout 1. In the embodiment shown in FIGS. 11 and 12, collar 29 and threads 32 have been eliminated and replaced by a fixed collar 60. Collar 60 is integral with fuel conduit 61 and projects radially therefrom to form an annular wall for engaging the upper edge of neck 30 of tank 3.

The annular space or clearance between sleeve 62 and conduit 61, which is designated by the number 63, is sealed to prevent the entry of foreign material such as dirt, sand or the like into the sliding interface 63 formed therebetween. This seal is provided by an annular skirt 64 depending from threaded cap 65 of sleeve 62. The lower edge of skirt 64 overlaps with the upper edge of an upstanding annular flange 66 projecting from the outer end of collar 60. The skirt 64 and overlapping flange 66 form a tortuous path designated by the numeral 67 in FIG. 11 that effectively prevents the entry of foreign material into sliding interface 63. In addition to skirt 64 and flange 66, the seal may incorporate an annular jacket 68 of resilient foam material that surrounds the sleeve 62 and conduit 61 that functions as a filter for any particular matter that may pass through the tortuous path 67 formed by skirt 64 and flange 66. Preferably, jacket 68 is formed of a polyethylene open cell foam material that has sufficient resiliency in the axial direction to permit compression as shown in FIG. 12 and recovery from such deformation to its original shape as shown in its noncompressed form in FIG. 11. As shown best in FIGS. 11 and 12, jacket 68 is disposed between skirt 64 and flange 66, and the sleeve 62 and conduit 61 at the location of sliding interface 63. Thus, jacket 68 preferably completely fills the space between skirt 64, flange 66, conduit 61 and sleeve 62.

The operation of the embodiment of pour spout 1 shown in FIGS. 11 and 12 is identical to that described with respect to FIGS. 1–10. The only significant difference is that collar 60 is fixed rather than adjustable like collar 29. However, it should be noted that a collar such as collar 29 may be incorporated into the external surface of conduit 4 if desired. This would lend added versatility with respect to this embodiment of pour spout 1.

While the above description has shown the invention as applied to a fuel container, it is contemplated that the pour spout can be utilized with a wide variety of containers or vessels.

Various modes of carrying out the invention are contemplated as being within the scope of the following claims particularly pointing out and distinctly claiming the subject matter which is regarded as the invention.

We claim;

1. A pour spout for conducting fluid from a container to a tank, comprising fluid conduit means having a first end defining a cap to be connected to a container for fluid and having a second end adapted to be disposed in communication with a neck of a tank, said fluid conduit means includes an outer conduit and a sleeve disposed concentrically within said conduit and slidable relative to said conduit, said outer conduit and sleeve defining a sliding interface therebetween, closure means for preventing flow of fluid through said fluid conduit means, said closure means having a closed position where said closure means seals the second end of said fluid conduit means and having an open position, means responsive to introducing said fluid conduit means into said tank neck for releasing said closure means and permitting fluid to flow through said fluid conduit means into said tank, and sealing means for preventing particulate foreign material from entering into said sliding interface, said sealing means comprises an annular skirt spaced from said outer conduit and depending from said cap and an upstanding annular flange projecting from said outer conduit, said skirt and flange overlapping to form a tortuous path for preventing the entry of foreign particulate material to said interface.

2. The spout of claim 1, wherein said closure means comprising a valve member connected to said sleeve.

3. The spout of claim 2, and including biasing means for biasing said valve member to a closed position.

4. The spout of claim 3, wherein said biasing means comprises a spring disposed between said conduit and said sleeve.

5. The spout of claim 3, and including abutment means projecting radially from said conduit and disposed to engage the neck of the tank, whereby manual longitudinal movement of said sleeve relative to said conduit after said abutment is engaged with said neck, will move said closure means to the open position.

6. The spout of claim 5, wherein said abutment means comprises an annular collar disposed on the outer surface of said conduit.

7. The spout of claim 6, wherein said collar is mounted for longitudinal movement on said conduit and said spout includes adjusting means for adjusting the position of said collar on said conduit.

8. The spout of claim 7, and including locking means for locking said collar relative to said conduit.

9. The spout of claim 8, wherein said adjusting means comprises a threaded connection between said collar and said conduit, said threaded connection comprising an internal thread on said collar and an external thread on said conduit, and said locking means comprising a projection on said internal thread and engageable with an interruption on said external thread.

10. The spout of claim 5, and including adjusting means for adjusting the position of said abutment means on said conduit.

11. The spout of claim 1 further including resilient filter means disposed between the skirt and flange and outer conduit and sleeve at the location of said sliding interface.

12. The spout of claim 11 wherein said resilient filter means comprises an annular jacket of resilient foam material.

13. The spout of claim 12 wherein said foam material is polyethylene.

* * * * *